US012203218B2

(12) United States Patent
Giusti et al.

(10) Patent No.: US 12,203,218 B2
(45) Date of Patent: Jan. 21, 2025

(54) RECYCLABLE COMPOSITE MATERIAL, IN PARTICULAR FOR FOOD PACKAGING

(71) Applicant: A.G. & Figli S.r.l., Viterbo (IT)

(72) Inventors: Stefano Giusti, Viterbo (IT); Martina Giusti, Viterbo (IT)

(73) Assignee: A.G. & FIGLI S.R.L., Viterbo (IT)

( * ) Notice: Subject to any disclaimer, the term of this patent is extended or adjusted under 35 U.S.C. 154(b) by 157 days.

(21) Appl. No.: 17/430,194

(22) PCT Filed: Feb. 24, 2020

(86) PCT No.: PCT/IB2020/051539

§ 371 (c)(1),
(2) Date: Aug. 11, 2021

(87) PCT Pub. No.: WO2020/170226

PCT Pub. Date: Aug. 27, 2020

(65) Prior Publication Data

US 2022/0153477 A1 May 19, 2022

(30) Foreign Application Priority Data

Feb. 22, 2019 (IT) ..... 102019000002595
Mar. 21, 2019 (IT) ..... 102019000004121

(51) Int. Cl.
*D21H 19/72* (2006.01)
*D21H 19/84* (2006.01)
*D21H 21/16* (2006.01)

(52) U.S. Cl.
CPC ..... *D21H 19/72* (2013.01); *D21H 19/84* (2013.01); *D21H 21/16* (2013.01)

(58) Field of Classification Search
CPC ..... D21H 19/72; D21H 19/84; D21H 21/16
USPC ..... 428/211.1
See application file for complete search history.

(56) References Cited

U.S. PATENT DOCUMENTS 6,358,596 B1 * 3/2002 Mehta ..... D21H 21/40 428/172
2001/0022866 A1 * 9/2001 Beer ..... B65D 75/46 383/211
2006/0198987 A1 9/2006 Grob et al.
2016/0010279 A1 1/2016 Hu et al.
2016/0237626 A1 8/2016 Anderson et al.
2017/0246836 A1 * 8/2017 Giusti ..... B32B 29/002
(Continued)

FOREIGN PATENT DOCUMENTS

CN 203753586 U 8/2014
CN 105603827 A 5/2016
CN 206781170 U 12/2017
(Continued)

OTHER PUBLICATIONS

European Bioplastics (Year: 2015).*
(Continued)

*Primary Examiner* — Betelhem Shewareged
(74) *Attorney, Agent, or Firm* — LUCAS & MERCANTI, LLP

(57) ABSTRACT

A recyclable material and packaging is provided. The material includes paper with weight of between 35 g/m$^2$ and 160 g/m$^2$ and maximum thickness of the overall material, excluding the heat-sealing overlapping areas, of between 35 μm and 310 μm.

17 Claims, 4 Drawing Sheets

(56) References Cited

U.S. PATENT DOCUMENTS

2022/0153477 A1* 5/2022 Giusti ..... B65D 33/04

FOREIGN PATENT DOCUMENTS

| | | | |
|---|---|---|---|
| EP | 3444400 | A1 | 2/2019 |
| EP | 3461637 | A1 | 4/2019 |
| JP | 20160074998 | A | 5/2016 |
| WO | 9944909 | A1 | 9/1999 |
| WO | 2015151027 | A1 | 10/2015 |

OTHER PUBLICATIONS

Office Action for Corresponding European Patent Application No. 20713957.7, Aug. 22, 2022, (1 page).

Office Action for Corresponding Chinese Patent Application No. 202080015809.5, Jul. 5, 2022, (27 pages) (No English Translation).

Office Action for Corresponding Chinese Patent Application No. 202080015809.5, May 31, 2023, (11 pages) with English Translation.

International Preliminary Report on Patentability for Corresponding International Application No. PCT/IB2020/051539 (6 Pages), Aug. 10, 2021.

Hu Wen, et a., "Preparation and Properties of CMC / Lignocellulosic Fiber Composite Paper", Paper Science and Technology, vol. 36, No. 6, pp. 1-3, to p. 65, 2017.

Chen Gang, et al., "Preparation and Mechanical Properties of the High Transparency Methylcellulose/Cellulose Fiber Composite Film", Journal of Composite Materials, vol. 35, No. 6, pp. 1574-1581, 2018.

International Search Report and Written Opinion for Corresponding International Application No. PCT/IB2020/051539 (9 pages) (Jun. 3, 2020).

* cited by examiner

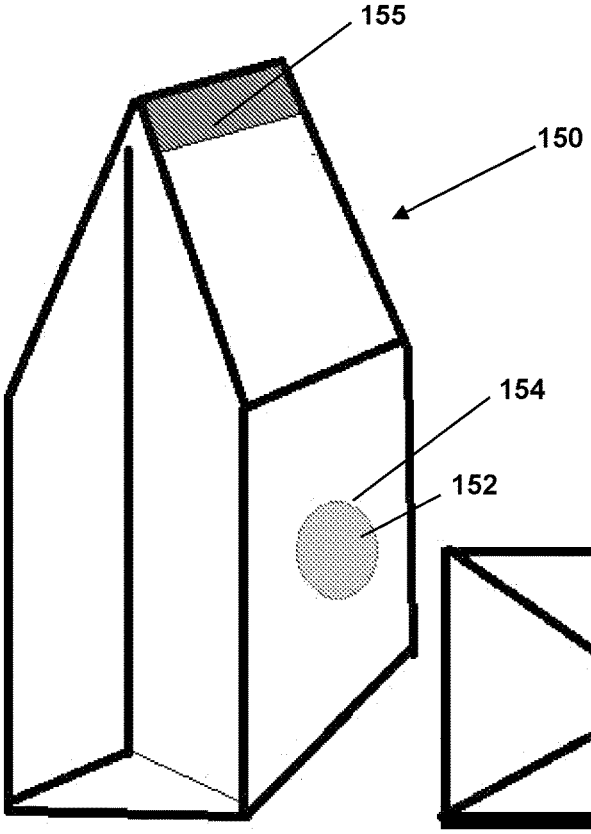
FIG. 8A
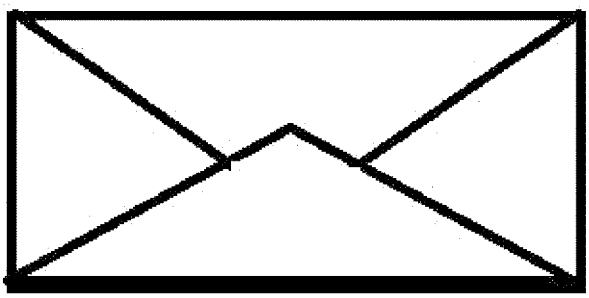
FIG. 8B
FIG. 9
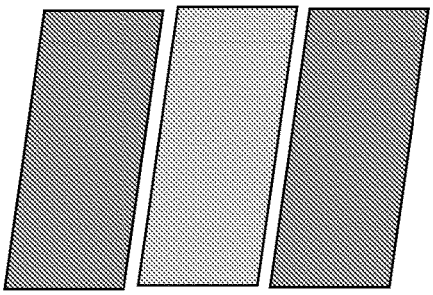

RECYCLABLE COMPOSITE MATERIAL, IN PARTICULAR FOR FOOD PACKAGING

TECHNICAL FIELD OF THE INVENTION

The present description relates to a recyclable composite material having a paper prevailing component and a packaging made of said composite material.

The composite material is preferably intended to food packaging and can have a transparent or translucent portion for viewing the packaged product.

Background

In the field of packaging the products to be put on the market through organized distributing channels, most part of packaging in direct contact with the contained product nowadays is made with plastic films which—in their various declinations, due to their nature of fossil origin and due to the combination of the different types of plastics—in the current state of technologies cannot be recycled.

Such missed recycling possibility generates a serious environmental damage and it is in clear contradiction with the circular economy systems pursued by all nations to reduce the carbon footprint.

Due to the increasingly stringent regulations in terms of environmental impact, the packaging waste issue has become a central political topic, so as to generate several initiatives, even of binding character, as demonstrated by the recent European directives EU 2018/852 and COM/2018/340-2018/0172, respectively related to "Packaging Waste Reduction" and "Disposable Plastics".

In many ways, by several firms, one is trying to give an answer to the above-illustrated topics.

The solutions of known art, even if in their validity from a concept point of view, belong to the category of the absolute compostable plastics or coupled to paper and they do not have everywhere a dedicated spinneret in the current recycling systems, thus resulting impossible to generate a real and effective end-of-life recovery. Therefore, it is not always possible to fully exploit the residual economic potential of the raw materials thereof the current packagings are made.

To the purpose of a correct exploitation of the residual value of the used packagings it is then essential that they can be addressed, indifferently, both in the recycling and composting spinneret.

Exactly for this reason—considering that paper is a both composting and recycling material and that the most effective recycling spinneret is that of paper—with increasing interest the firms orient towards solutions providing the use of this type of material.

Nevertheless, there is the need for making that the material for packaging, made of paper, works on the current systems and machines for automatic packaging, initially arranged to work with exclusively plastic materials. The latter are mostly of thermoplastic type and are sealed through a simple application of heat at the edge areas of the single forming packets. Then, in the current state, the packaging paper material is coupled to thin layers of plastic polymer or biopolymer, or treated with layers of adhesive, to produce the closing thereof.

For such materials coupled to paper, should one speak about compostability, EN 13432 or ASTM D6868 standards are available. However, when said materials are defined recyclable by the producer or user, in no way we are informed to which parameters reference is made to define said property.

According to CEPI (Confederation of European Paper Industries) Directives, paper recycling objective is that of producing high quality recycled paper, which could meet the technical specifications required by the users of the packaging fields. Consequently, the products which one wishes to declare recyclable in the paper spinneret have to be planned so as to provide paper for a quality and value recycling, as requested by UNI EN 643 standard.

In particular, a manufactured product mainly made of paper can be defined recyclable when the cellulosic fibres thereof it consists lead to the production, in effective and efficient way from the technologic and economic point of view, through the currently most widespread paper production methods, of a new sheet of paper or cardboard of quality suitable to the market's needs.

Currently, the directives established by the various countries all over the world and by their own organizations dealing with these themes, are quite clear and they can be synthetized through two reference standards:

ATICELCA MC 501 for Europe, and

Voluntary Standard For Repulping and Recycling Corrugated Fibreboard Treated to Improve Its Performance in the Presence of Water and Water Vapor of Western Michigan University for USA.

These standards define the parameters which, through specific tests corresponding to as many International ISO or ASTM regulations, allow to establish what it is possible to make recyclable within the paper spinneret and on the contrary, what cannot be made recyclable.

Now, whereas the design of paper packaging products, such as for example boxes or cases made of cardboard, does not result to be particularly complex, the packaging machines thereof have been planned specifically for these types of materials, a problem of totally different nature is that of implementing a packaging made of paper which results to be recyclable in paper according to the mentioned standards and, at the same time, could also be sent to the composting spinneret and moreover is capable to work effectively on packaging plants originally arranged for treating plastic materials.

SUMMARY OF THE INVENTION

The object of this invention is then to obtain a composite material mainly constituted by paper, in case having a transparent area apt to allow viewing the contained product and a relative packaging allowing to meet the above-illustrated requirements.

In the context of the present invention, if not otherwise defined, under "composite material" a material is meant comprising several component materials, also called base materials, arranged in adjacent, overlapped or partially overlapped layers.

In particular, the invention proposes a recyclable composite material mainly constituted by paper resulting compostable and workable in the current automatic packaging machines, originally arranged for treating plastic materials.

In order to obtain the above-mentioned technical effects, the Inventors have developed a composite material with selected physical and mechanical properties.

The composite material and the packaging of the invention, advantageously, are suitable for food. Advantageously, in the embodiments wherein the above-mentioned viewing transparent area is implemented by using one or more component materials different from paper, the percentage by weight of such component materials does not exceed 15% of the overall weight of the resulting packaging.

In other embodiments, the viewing area is implemented with a paper made transparent through the use of a filling substance or material with a refractive index near the refractive index of cellulose, in particular 1.48 and, in preferred embodiments, it is selected to have a refractive index of about 1.53 at the light wavelength of $\lambda$=550 nm.

The filling material can be selected from a wide group of materials, in particular one or more from the following ones:

- thermosetting polymers, such as for example polyester fibreglass, polyurethane polymers, vulcanized rubber, bakelite, duroplast, urea-formaldehyde, melamine resin, diallyl-phthalate (DAP), polyimides;
- bismaleimides, or polycarbonates, furan resins, polyester resins, silicone resins, benzoxazine resins, bis-maleimides (BMI), epoxy (epoxy) resins, phenolic resins (PF), polyester resins, polyimides, polyurethane (PUR) resins, silicone resins, vinylester resins, oily substances;
- thermoplastic polymers, such as for example acrylic, ABS, nylon, PLA, polybenzimidazone, polycarbonate, polyether sulfone, polyetherterketone, polyetherimide, polyethylene, polyphenylene oxide, polyphenylene sulfide, polypropylene, polystyrene, polyvinyl chloride, teflon;
- cellulose derivatives, such as for example, cellulose acetate, cellulose acetate butyrate, cellulose triacetate, methyl cellulose, hydroxypropylmethyl cellulose, ethylcellulose, hydroxyethylcellulose, carboxymethyl cellulose, dissolved cellulose, nanofibrillated cellulose, cellulose nanochrystals;
- functional index matching materials, such as for example liquid crystal, materials sensitive to pressure/temperature, piezoelectric materials;
- colourless polymeric nanopolymer, precursor of transparent liquid epoxy resin at low viscosity, a mixture of a resin with non-reddening cycloaliphatic hardener, polyvinylpyrrolidone (PVP), poly (methylmethacrylate) (PMMA), poly (vinyl alcohol) (PVA), polydimethylsiloxane (PDMS) and the like.

In order to make paper transparent any one of the methods known in the art can be used. By way of example, a method to make paper transparent is based upon impregnation of the same with products having a refraction index similar to that of the cellulose. Among the preferred filling materials there are surely oily substances such as, for example, polyethylene glycol and glycerine.

Once impregnation is obtained, the paper tape is made to pass through hot cylinders to remove the exceeding portion of the impregnation material and, at the same time, to allow the liquid product to occupy all inter-fibre spaces, in this way by generating a better product transparency, having thus removed the air trapped inside the fibrous context, and having replaced it with a filling material with suitable refraction index.

Then, with the purpose of removing the greasiness feeling that the treated product has, in case a layer of polyvinyl alcohol (PVOH) is spread on the surface, which alcohol, since it has a similar refraction index (1.56), has the double aim of entrapping the oily portion inside the structure, thus by preserving the function thereof of activating the sheet transparency and, then during the recycling phase PVOH melts due to the water bath effect, it allows to remove the oily layer through the action generated by the layer of sodium silicate existing in the structure of the opaque sheet (sheet WO2015151027A1) thus by making possible to reuse the fibre thereof the transparent portion consists.

The resulting above-mentioned paper made transparent can have a light transmission variable from 60% to 95% and an optical haze varying about from 60% to 100% in the range of wavelengths of visible light from 400 nm to 1100 nm. The optical properties depend, even if not exclusively, upon the selection of the infiltrating materials, that is the above-mentioned filling materials.

Therefore, differently from the paper packaging described in the art, for example the one described in FR2915468A which has not been subjected to any treatment type and, at most, has a translucent effect allowing to view the packaging content only if the product is put in direct contact with paper, the paper made transparent according to any one of the herein described embodiments is really transparent.

In these last embodiments, the material, and the relative packaging, then can be made of paper only, substantially without any percentage of waste, that is the material is wholly recyclable.

Moreover, in another variant, the paper made transparent can be reinforced by means of an additional layer of material (for example cellulose hydrate, preferably with low thickness) applied inside the layer of transparent paper. Even in this case, the waste can remain within the limit of 5%.

These embodiment variants are particularly suitable, for example, for packaging dry pasta, for example the format known as "penne".

In a further variant, the layer, for example of cellulose hydrate, applied as reinforcement to the transparent paper was replaced with a layer of polyvinyl alcohol in form of film. This solution, from a technical point of view, results extremely effective, since it allows to implement zero-waste packaging, considering that the polyvinyl alcohol is soluble in water and, then, it does not generate waste of any type during recyclability test.

As said above, the composite material of the invention can be used on usual automatic packaging machines designed to work mainly with plastic materials, so as to form a packaging closed through a sealing process obtained with any system existing on standard packaging machines. Preferably, said material, after having performed its original container function, can be conferred in paper recycling, by meeting EN 643, ATICELCA MC 501 reference standards according to the parameters of categories "A+ and A" of the Voluntary Standard For Repulping and Recycling Corrugated Fibreboard Treated to Improve Its Performance in the Presence of Water and Water Vapor of Western Michigan University (USA).

Moreover, the material preferably is so as to be able to be sent to the composting spinneret according to EN 13432 and ASTM D6868 standards.

BRIEF DESCRIPTION OF THE FIGURES

Figures of the enclosed drawings will be shown, by way of example, wherein:

FIGS. 8A and 8B relate to an additional embodiment variant of the packaging of FIG. 3, showing an exemplifying schematic view thereof, a perspective side and bottom view respectively;

FIG. 9 shows a schematic representation of an approaching between side areas made of paper with coating, in particular heat-sealing lacquer, and central area made of transparent component material.

Figure 1:
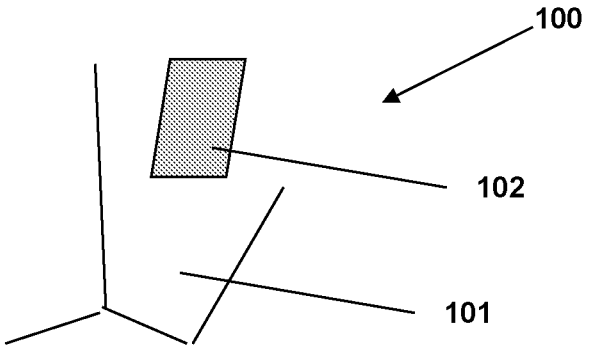
FIG. 1 shows an exemplifying schematic view, in perspective, of a composite material in sheet with transparent viewing area, according to an embodiment of the present invention.

The thicknesses and the sizes represented in the above-mentioned figures are to be meant as a pure example, they are generally magnified and not necessarily shown in proportion.

DETAILED DESCRIPTION OF PREFERRED EMBODIMENTS

Several embodiments and variants of the invention will be described hereinafter and this with reference to the above-mentioned figures.

Analogous components are designated in the several figures with the same numeral reference.

In the following detailed description, embodiments and variants additional with respect to embodiments and variants already treated in the same description will be illustrated limited to the differences with what already illustrated.

Moreover, the several embodiments and variants described hereinafter are subjected to be used in combination, where compatible.

The present invention relates to a recyclable composite material for making packagings, the latter preferably for food products.

The material is in form of sheet and can be obtained by lamination of overlapped or partially overlapped layers, in case coupled by means of one or more adhesives.

The composite material comprises one or more component materials, in particular at least a paper component material in prevailing percentage by weight with respect to other possible component materials.

Each component material advantageously is in form of sheet, typically laminated.

The paper component material occupies a percentage by weight of about ≥85% of the composite material as a whole. Such value can be measured by means of ATICELCA 501 standard evaluation tests.

Advantageously, such paper component material has a weight comprised in a range of about 35-160 g/m$^2$.

Advantageously, one of the component materials is a substantially transparent or substantially translucent material.

Preferably, the composite material has a maximum thickness comprised in a range of about 35-310 μm.

The composite material, based upon preferred embodiments, has compostability features according to EN 13432 and/or ASTM D6868 501 standards.

The composite material of the invention, and in particular the one of the above-described embodiment, can be used in automatic packaging machines to implement a recyclable packaging and in case to reclose the packaging itself around a product to be packed, for example food product. Various packaging shapes are possible, as it will be illustrated hereinafter with reference to the above-mentioned Figures.

Generally, the packaging can have a winding shape with a substantially pocket-like or tubular structure, so as to leave a through-opening or side opening for inserting the food product.

The packaging typically provides areas for overlapping or side-by-side-placing two or more layers of the composite material fastened to one another, in particular to close the packaging. Such closing can take place by heat-sealing the material portions overlapped or placed side by side and/or by means of application of adhesive, the latter for example in form of coating, in particular lacquer. Generally, the materials used to implement the composite material have no intrinsic heat-sealing features and therefore, in order to make the packaging heat-sealing, it is necessary to provide the belt with coatings of products such as, for example, polyvinyl alcohol, heat-sealing vinyl adhesives, acrylic resins or mixtures thereof.

In particular, heat-sealing adhesives can be used which—through heat administration or development at the overlapping/side-by-side placing and then sealing areas of the packaging, for example by electromagnetic induction—indeed determine the packaging closing. Advantageously, such adhesives do not generate residual adhesiveness measured based upon ISO 15360-2 standard.

Adhesives suitable to the purpose of the present invention can be selected from the group constituted by, but not limited to: acrylic resins, polyvinyl alcohol, vinyl adhesives and mixtures thereof.

Based upon preferred embodiments, the packaging has a substantially transparent or substantially translucent area, or window, for viewing the packaged product, implemented by means of the corresponding above-mentioned component material.

Preferably, the above-said viewing area extends on a surface portion of 50% of the overall external surface of the packaging itself.

Based upon an embodiment, the viewing area generates a coarse waste, measured with the test method Tappi T 275 sp-07, ≤5%.

Advantageously, directly on the composite material or on the packaging prints can be applied. In particular, the packaging can have a surface area printed with inks. Based upon a preferred embodiment variant, such printed surface area occupies the overall external surface of the packaging itself in percentage comprised in a range of about 1%-100%.

Advantageously, the applied inks do not produce optical inhomogeneity higher than level 3 of the reference scale designated by the method ATICELCA 501-17.

Advantageously, still directly on the composite material or on the packaging internal and/or external surface treatment and/or coatings can be present, suitable to implement a barrier function to one or more of the following: water vapour, oxygen, mineral oils, glidant.

Based upon a particularly preferred embodiment, on the paper component material there are internal and/or external surface treatments and/or coatings, suitable for protecting the cellulose fibres, so as to allow the detachment of any inks or other types of surface treatment in a phase for recycling the composite material or the packaging implemented therewith.

Advantageously, any internal or external applied coating is of the type suitable not to produce so-called "macrostikies", that is agglomerations with other sub-elements or components with different compostability modes.

Preferably, said internal and/or external surface treatments or coatings, intended to protect the cellulosic fibres so as to allow the detachment of possible inks or other types of surface treatment, are obtained according to the teachings of WO2015151027A1, herein integrally incorporated by means of this reference. By way of example, suitable coatings can be selected from the group constituted by, but not limited to: PLA, PHB, PCL, coatings applied in liquid form which do not require an adhesive to make them to adhere to the sheet surface.

Advantageously, the composite material and the packaging of the invention can be recyclable in the paper collection, preferably based upon one or more of the current ATI-CELCA 501 standards classes A+ and A; Voluntary Standard For Repulping and Recycling Corrugated Fibreboard Treated to Improve Its Performance in the Presence of Water and Water Vapor of Western Michigan University (USA); collection provisions of German government in force since Jan. 1, 2019 (Entwurf eines Gesetzes zur Fortentwicklung der haushaltsnahen Getrennterfassung von wertstoffhaltigen Abfällen).

Advantageously, the composite material and the packaging of the present description are based upon, or obtain, one or more of the technical effects illustrated hereinafter, to be considered singularly, in combination or in sub-combinations.

- Workability on automatic packaging machines of so-called vertical or horizontal type, shrink wrappers, bagging machines and the like.
- Capability of heat-sealing the packaging implemented with already existing equipment and used in standard way for closing packets with presence of plastic polymers or more generally heat-sealing adhesives.
- Implementations of heat-sealed closed packaging in the edge areas which can have at least a transparent or substantially transparent area implemented also with material different from paper.
- Conferring capability of the packaging in the paper collection systems according to the European and American standards, the main and more strict ones, already mentioned above, are:
  - (i) Italy—Aticelca MC 501 Parameters A+ and A,
  - (ii) Germany—Entwurf eines Gesetzes zur Fortentwicklung der haushaltsnahen Getrennterfassung von wertstoffhaltigen Abfällen,
  - (iii) USA—Voluntary Standard For Repulping and Recycling Corrugated Fibreboard Treated to Improve Its Performance in the Presence of Water and Water Vapor of Western Michigan University,
  - (iv) EN 13432,
  - (v) ASTM D 6868.

The invention has one or more of the following parameters or properties selected by the Inventors—to be considered singularly, in combination or in sub-combinations—apt to confer to the final composite material and to the packaging implemented therewith the above-mentioned recyclability, compostability and workability features.

- Weight of the paper component material comprised in a range of about 35-160 g/m$^2$.
- Thickness of the paper component material comprised in a range of about 35-200 μm.
- Weight of the substantially transparent or substantially translucent material comprised in a range of about 20-90 g/m$^2$.
- Thickness of the single substantially transparent or substantially translucent component material comprised in a range of about 15-100 μm.
- Presence of packaging areas with heat-sealing adhesive deposit with percentage comprised in a range of about 2%-100% of the surface of the single packaging.
- Amount of deposited heat-sealing adhesive comprised in a range of about 5-40 g/m$^2$ per unit of surface occupied by the deposit.
- Preferably, maximum number of materials or component elements (or layers) constituting the packaging equal to eleven different elements, such as for example those enlisted hereinafter, to be considered singularly, in combination or in sub-combination too and preferably according to the sequence of layers in sheet or coating shown hereinafter.
  - (a) A paper as main supporting component material, with weight comprised in a range of about 35-160 g/m$^2$.
  - (b) An internal coating protecting the cellulosic fibre, for example made of silicate, to allow the detachment of the component material used for implementing the above-mentioned transparent viewing area (WO2015151027A1 is herein wholly incorporated by means of this reference).
  - (c) A substantially transparent or substantially translucent component material comprised in a range of about 20-90 g/m$^2$, used for implementing the above-mentioned viewing area (for example, selected from: cellulose hydrate—polylactic acid—polyvinyl alcohol—translucent transparent paper—polyester or mixtures thereof).
  - (d) An internal coating protecting the cellulosic fibre, for example made of silicate, to allow the detachment of the component material used for implementing the above-mentioned transparent viewing area (WO2015151027A1 is herein wholly incorporated by means of this reference).
  - (e) A possible reinforcement component material for protecting the transparent or translucent component material, applied at the viewing area, preferably substantially transparent or substantially translucent too, having weight comprised in a range of about 20-90 g/m$^2$ (for example, selected from: cellulose hydrate—polyvinyl alcohol or mixtures thereof).
  - (f) An internal coating protecting the cellulosic fibre, for example made of silicate, to allow the detachment of the component material used for implementing the above-mentioned transparent viewing area (WO2015151027A1 is herein wholly incorporated by means of this reference).
  - (g) inks, advantageously applied at the external portion of the composite material and of the packaging.
  - (h) An internal coating with features variable as a function of the contained product, in particular with one or more of the following properties:
    - barrier to water vapour (for example, acrylic or ethylene-acrylic resin, in case with addition of a charge such as for example, kaolin);
    - glidant (for example, polydimethylsiloxane)
    - barrier to oxygen (for example, polyvinyl alcohol with high hydrolizing index); and
    - barrier to mineral oils (for example, polyvinyl alcohol at different hydrolizing levels).

(i) An external coating with features variable as a function of the contained product:
barrier to water vapour (for example acrylic and/or ethylene-acrylic resins);
glidant (for example polymethylsiloxane and/or calcium stearate);
barrier to oxygen (for example, polyvinyl alcohol);
barrier to mineral oils (for example, polyvinyl alcohol and/or silicate);
(j) Internal heat-sealing adhesive (for example, vinyl resin);
(k) External heat-sealing adhesive (for example, vinyl resin).

Percentage by weight of non-paper materials measured before the recyclability of ≤40% (measurement obtained through the physical separation of the components of the packaging different from paper).

Viewing area of the single packaging occupying a percentage of the overall surface of the packaging ≤50%.

Percentage of coarse waste measured after test Tappi T275 sp-07≤15%.

Area of adhesive particles measured based upon ISO 15360-2 standard with diameter lower than 2,000 μm in maximum amount in number of 10,000 units.

Fibre flakes measured after the pulping phase implemented based upon UNI EN ISO 5263 standard and coarse waste of ≤15% measuring method Tappi 275 sp-07.

Adhesivity of recycled material, measured according to the method ISO 15360-2, absent.

As it will appear evident to the person skilled in the art, not always it will be required to use the eleven above-described layers to obtain a suitable composite material. For example, in case of dry products (such as dry pasta and legumes), wherein no particular barrier is requested, the number of layers of the composite material could be reduced to seven, in particular as shown hereinafter:

1. Inks (1-5 g/m$^2$)
2. Paper (40-160 g/m$^2$)
3. External heat-sealing adhesives
4. silicate with detaching function (3-20 g/m$^2$)
5. adhesive by gluing transparent window area (3-10 g/m$^2$)
6. transparent area material (20-90 g/m$^2$)
7. internal heat-sealing adhesive (10-30 g/m$^2$)

Other embodiments of the invention are described hereinafter by way of example and not for limitative purposes.

Package for Packing Durum Wheat Pasta and/or Dry Legumes

From outside:

| | |
|---|---|
| polymethylsiloxane | 3 g/m$^2$ |
| inks | 5 g/m$^2$ |
| paper | 100 g/m$^2$ |
| silicate | 10 g/m$^2$ |
| adhesive by gluing transparent material | 5 g/m$^2$ |
| transparent area material | 23 g/m$^2$ |
| heat-sealing adhesives | 20 g/m$^2$ |

On a typical format for dry pasta this 35 cm of band×28 of cutting pitch translates into the following unit weights:

| | |
|---|---|
| paper | 84% |
| Silicate | 8% |
| PDMS | 2.5% |
| Inks | 4% |
| Adhesives and heat-adhesives | 0.1% |
| Transparent window | 2.9% |

As it will be clear to a person skilled in the art, the above-mentioned values are purely indicative, in particular those of the transparent window, since they are function of the size requested by the customer. Obviously, the waste percentage always falls within the above-mentioned values.

The above-mentioned values were tested through laboratory analyses performed according to the reference standards, as illustrated hereinafter.

Sampling and Sample Preparation

An amount of material was arranged, sufficient to perform all measurements provided by the method ATICELCA 501/17 (indicatively 200 g of atmospheric dry weight).

The content of dry matter of the material or product was determined according to the directive UNI EN ISO 287.

Two aliquots of material with precision of 0.01 g were weighed, each one corresponding approximatively to 50 g dry.

The samples were cut in pieces with size approximatively of 3 cm×3 cm.

All amounts of sample mentioned subsequently in the text relate to the calculated dry weight in stove at 105° C.

Packaging Pulpability Performed with Directive UNI EN ISO 5263-1

In order to perform the test, one proceeds with pulping the material and pre-arranging at least two samples of dough for the subsequent analyses.

50 g of sample were pulped with apparatus according to the method UNI EN ISO 5263, by using mains water at temperature of about 40° C.

The material was added into the pulper and water was poured without performing a pre-wetting of the sample before pulping.

The sample was pulped for 10 minutes (30.000 revolutions) with consistency of 2.5%, corresponding to 50 g of material in a total volume of 2 l.

At the end of pulping, the whole dough was fully recovered from pulper, by helping with water.

Coarse Waste Measurement

One proceeds with determining the coarse waste starting from the diluted dough. One proceeded with the coarse screening phase by using a fractionator apparatus of Somerville type, equipped with suitable plate with holes having diameter equal to 5 mm.

The coarse screening test was performed for a period of time equal to 5 minutes with water flow equal to 8 l/min.

The first 10 litres of accepted coarse screening were recovered in suitable container, to be used for the subsequent measurement of the flakes and the macrostickies, and the consistency was determined.

At the test end the whole waste existing on the plate was recovered in suitable container by washing the plate with required amount of water for complete cleaning.

The waste was filtered on quick paper filter previously calibrated in stove at 105° C., by using a funnel Buchner.

The filter with waste was recovered and dried in stove at 105° C. until obtaining a constant weight.

The dry weight of the coarse waste was calculated, net of the paper filter weight, and the result expressed as percentage of coarse waste with respect to the dry weight of the starting sample, by rounding the result up to the first decimal place.

Measurement of Flakes

One proceeded with determining the content of flakes existing in the accepted dough after coarse screening.

A fractionator apparatus of Somerville type was used, a screening test was performed by using the plate with slots having width equal to 0.15 mm, a dough quantity equal to 5 g dry, for a period of time equal to 5 minutes and with water flow equal to 8 l/min.

At the end of the test the flakes existing on the plate were recovered in suitable container, by washing the plate with suitable water quantity so as to recover the fragments entrapped in the slots.

The flakes were filtered on quick paper filter previously calibrated in stove at 105° C., by using a funnel Buchner.

The filter with the flakes was recovered and wholly dried in stove at 105° C. until obtaining a constant weight.

The dry weight of the flakes was measured, net of the paper filter weight and the percentage was calculated with respect to the dry weight of the aliquot of accepted dough used for the test.

Measurement of the Adhesive Particles (Macrostickies)

One proceeded with evaluating the quantity of adhesive particles, called macrostickies, existing in the accepted after the coarse screening phase. Determination according to the method ISO 15360-2 with the following specifications:

- a plate with slots having width equal to 0.10 mm was used;
- initially a dough amount equal to 10 g dry was used;
- a fractionator apparatus of Somerville type was used, the screening test was performed for a period of time equal to 10 minutes with water flow equal to 8 l/min;

The tests were produced for measuring the macrostickies according to the method ISO 15360-2.

The obtained tests were measured by means of an image analysis system, by setting the size limit of the classes of particles with minimum equal to 0.1 mm and maximum equal to 2.0 mm with equivalent diameter.

The area of the macrostickies smaller than 2.0 mm of equivalent diameter was measured and the result of the image analysis measurements was expressed as $mm^2$ of area of macrostickies per kg of sample as such, rounding the result up to ten.

The average value and the minimum value and the maximum value of the area measured in the different repetitions was calculated, the result was rounded up to the first ten.

Adhesion Test Performing and Evaluation of the Optical Inhomogeneities

One proceeded with verifying the adhesivity of the produced sheets starting from the accepted obtained in the test for determining the content of macrostickies.

After having homogenized the accepted obtained in the test for determining the content of macrostickies and determined the fibre consistency, a portion was collected sufficient for preparing two 60-g/$m^2$ sheets (corresponding to 1.8 g dry for each sheet).

The sheet was dried in the drier of Rapid-Köthen and transferred, without removing the respective support (board carrier) and cover (cover sheet), in a stove at the temperature of 130° C.

The sheet was positioned between two metal plates at the same temperature, by applying a pressure of 1.18 kPa (3.7 kg) on the whole sheet surface for 2 minutes. Then the sheet with support and cover was removed from the stove and left to cool down for 10 minutes in a dryer.

The sheet was separated from the support and from the cover, possible sheet damages or rupture were evaluated, indexes of adhesivity presence.

The result was expressed by assigning a judgment based upon the following scale:

- Absent adhesivity: the sheet separates in its integrity from the support and cover, without having damages and ruptures. Traces of fibres on the support and/or on the cover are allowed. Paper fragments on the support and/or on the cover are not allowed.
- Existing adhesivity: the sheet does not correspond to the definition of absent adhesivity.

The quantity and type of optical inhomogeneities present on both sides of the sheets was evaluated visually by means of comparison with the references shown in enclosure 3 of Method ATICELCA 501/17.

Table of values found in the tests based upon the different combinations of materials used for making the packaging.

The results shown below were obtained by testing the composite material of the packaging for durum wheat pasta and/or dry legumes with the above shown composition.

| Packaging made of | Pulpability | Coarse waste | Flake measurement | Measurement of adhesive particles | Adhesion | Optical inhomogeneity Level | Classification recyclability level based upon the ATICELCA standard 501/17 |
|---|---|---|---|---|---|---|---|
| Paper only | Good | 1.5% | <5 | <2500 | absent | 2 | A+ |
| Paper with transparent window made of paper | Good | 1.5% | <5 | <2500 | absent | 2 | A+ |
| Paper with transparent window made of paper and reinforcement made of material different from paper | Good | 15% | <5 | <2500 | absent | 2 | A |
| Paper with transparent window made of material different from paper | Good | 15% | <5 | <2500 | absent | 2 | A |

The methods and unit of measurement are the above-mentioned ones.

As mentioned above, the possible shapes and configurations for closing a packaging according to different embodiments and variants of the invention will be now described with reference to the above-mentioned figures.

Figure 2:
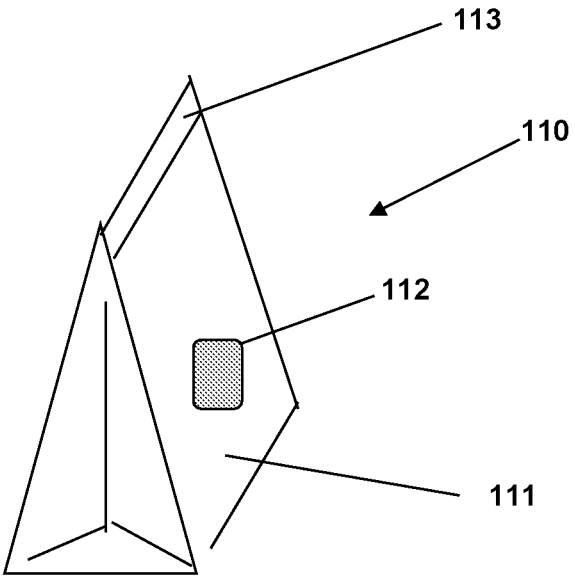
FIG. 2 shows an exemplifying schematic view, in perspective, of a packaging with transparent viewing area according to an embodiment of the present invention.

By firstly referring to FIGS. 1 and 2, a composite material 100 is formed by a prevailing paper supporting material 101 and by a transparent or translucent component material 102. The material 100 is in form of continuous belt or sheet, or it is already sectioned in units individually suitable to implement a packaging.

The material 100 is used to implement a packaging 110. The latter has a main body 111 in form of pyramidal polyhedron small bag, advantageously with side bellows regions, and it is equipped with a transparent viewing area 112. The small bag has an entrance area 113 re-closed or re-closable on the packaged product by heat-sealing overlapped or side-by-side placed portions of composite material.

Figure 3:
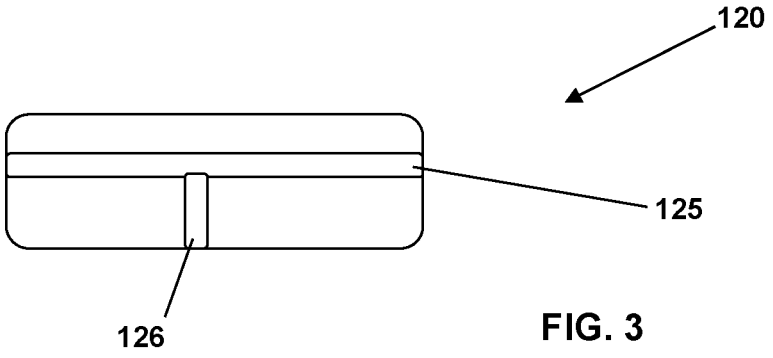
FIG. 3 shows a bottom schematic view exemplifying a packaging according a different embodiment of the present invention.

FIG. 3 relates to a packaging 120 with different shape, in particular of parallelepiped type with rounded, or cushion-like, angles.

Figure 4:
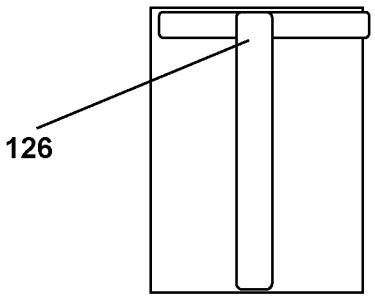
FIG. 4 shows a schematic rear side view of the packaging of FIG. 3.

As shown in this figure, which illustrates schematically a bottom of the packaging, two closing areas are provided, even in this case heat-sealed, and, in particular, a cross area 125 extending along the bottom and a side area 126 indeed extending even on the side of the packaging, as it can be seen even in the rear side view of FIG. 4.

Figure 5:
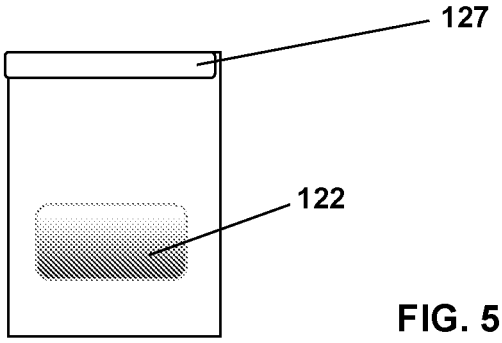
FIG. 5 shows a schematic front side view of the packaging of FIG. 3.

The packaging 120 too has a viewing area, shown in the front side view of FIG. 5 and designated with 122.

The packaging 120 further has an upper front closing area, heat-sealed too, 127.

Figure 6A:
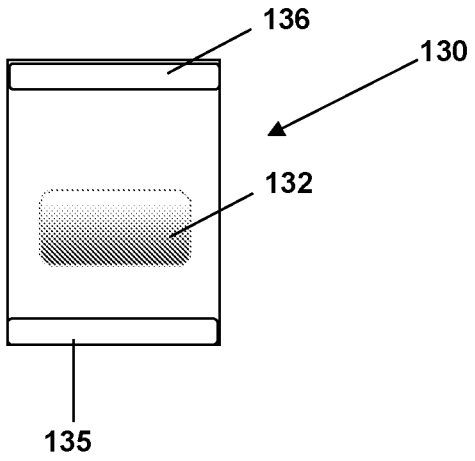
FIGS. 6A and 6B relate to an embodiment variant of the packaging of FIG. 3, showing an exemplifying schematic view thereof, a front side view and a rear side view respectively.
Figure 6B:
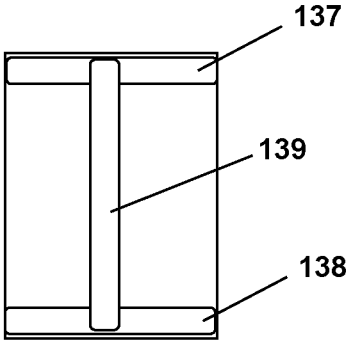

In the embodiment variant of FIGS. 6A and 6B a packaging, designated with 130, has a viewing area 132, front too, and two upper and lower cross closing areas, respectively 135 and 136, visible on the front side, two corresponding cross closing areas 137 and 138 visible on the rear side and a rear longitudinal closing area 139.

Figure 7A:
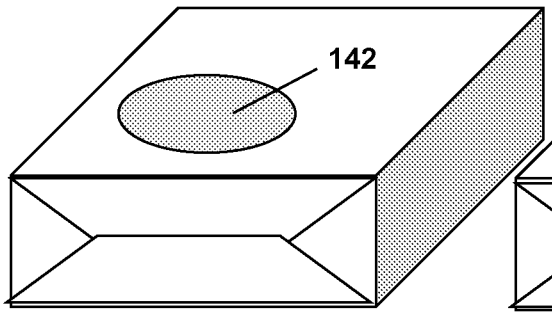
FIGS. 7A and 7B relate to another embodiment variant of the packaging of FIG. 3, showing an exemplifying schematic perspective view thereof, from top and bottom respectively.
Figure 7B:
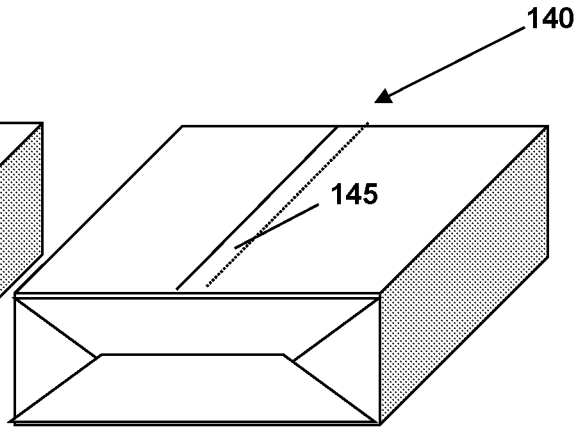

FIGS. 7A and 7B relate to an additional embodiment wherein the packaging, designated with 140, is in so-called bungled form. The packaging 140 has an upper viewing area 142 and a lower cross closing area 145.

FIGS. 8A, 8B and 9 relate to another embodiment wherein the packaging, designated with 150, is in form of so-called preformed small bag, with a substantially parallelepiped main body, on the lower side, and a substantially pyramidal polyhedron main body, on the upper side. The packaging 150 has a front side viewing area 152 and an upper cross closing area 145. At the upper corner, a deposition of heat-sealing lacquer 155 is provided. A similar deposition 154 is inserted to weld the material constituting the viewing area 152 to the paper main body.

The present invention has been so far described with reference to preferred embodiments. It is to be meant that other embodiments belonging to the same inventive core may exist, as defined by the protective scope of the herebelow reported claims.

The invention claimed is:

1. A recyclable composite material for making packagings for food products, which composite material is in the form of a sheet or a continuous strip, which composite material comprises a paper component material in percentage by weight of about ≥85% of the total weight of the composite material, which paper component material has a weight in a range of about 35-160 g/m$^2$, and which composite material has a maximum thickness in a range of about 35-310 μm, wherein the composite material further comprises a substantially transparent or substantially translucent area consisting of one or more of: cellulose acetate, cellulose acetate butyrate, cellulose triacetate, cellulose hydrate, methyl cellulose, hydroxypropylmethyl cellulose, ethylcellulose, hydroxyethylcellulose, carboxymethyl cellulose, dissolved cellulose, nanofibrillated cellulose, cellulose nanocrystals, and wherein the recyclable composite material has recyclability properties of least an A according to ATICELCA 501 and meets Voluntary Standard For Repulping and Recycling Corrugated Fibreboard Treated to Improve Its Performance in the Presence of Water and Water Vapor of Western Michigan University.

2. The composite material according to claim 1, wherein said paper component material has a thickness in a range of about 35-200 μm.

3. The composite material according to claim 1, wherein said substantially transparent or substantially translucent component material is made starting from paper treated by impregnation, wherein said treated paper has a light transmission variable in a range of about 60%-95% or an optical haze variable in a range of 60%-100% in the range of wavelengths of visible light being 400-1100 nm.

4. The composite material according to claim 1, wherein said substantially transparent or substantially translucent component material has a weight in a range of about 20-90 g/m$^2$ and/or a thickness in a range of about 15-100 μm.

5. The composite material according to claim 1, comprising areas having a deposition of adhesive.

6. A recyclable packaging for food products, which is made of a composite material according to claim 1.

7. The packaging according to claim 6, which has an enveloping shape with a substantially pocket-like or tubular structure.

8. The packaging according to claim 6, which provides areas for overlapping or placing side by side two or more layers of said composite material fixed to one another to close the packaging, preferably by heat-sealing.

9. The packaging according to claim 8, having, at said overlapping or side-by-side placing areas, an adhesive layer preferably of heat-sealable type and preferably deposited on a surface area corresponding to a percentage in a range of about 2%-100% of the total surface of the single packaging.

10. The packaging according to claim 6, having a substantially transparent or substantially translucent viewing area or window.

11. The packaging according to claim 10, wherein said viewing area extends over a surface portion occupying a percentage of ≤50% of the overall external surface of the packaging itself.

12. The packaging according to claim 10, wherein said viewing area generates a coarse waste, measured with the test method Tappi T 275 sp-07, ≤15%.

13. The packaging according to claim 6, wherein there is an area printed with inks occupying a percentage of the overall external surface of the packaging itself in a range of about 1%-100%.

14. The packaging according to claim 6, wherein there are internal and/or external surface treatments and/or coatings, suitable to implement a barrier function to one or more of the following: water vapor, oxygen, mineral oils; and/or with sliding properties or for protecting the cellulose fibers, so as to allow the detachment of possible inks or other types of surface treatment in a recycling phase.

15. The composite material according to claim 5, wherein the adhesive is a heat-sealable adhesive.

16. The composite material according to claim 5, wherein an amount of the deposited heat-sealable adhesive is in a range of about 5-40 $g/m^2$ per unit of surface occupied by the deposit.

17. The composite material according to claim 4, wherein the thickness is in a range of about 15-100 μm.

* * * * *